US005770267A

United States Patent [19]

Bullock, Jr.

[11] Patent Number: 5,770,267

[45] Date of Patent: Jun. 23, 1998

[54] METHOD AND APPARATUS FOR SMOOTHING SUBSTRATE SURFACES

[75] Inventor: Ralph S. Bullock, Jr., Agoura, Calif.

[73] Assignee: J. M. Huber Corporation, Edison, N.J.

[21] Appl. No.: 628,503

[22] Filed: Apr. 5, 1996

[51] Int. Cl.[6] ..... B05D 3/12; B05C 11/04

[52] U.S. Cl. ..... 427/356; 427/440; 118/50; 118/123; 118/125; 118/126

[58] Field of Search ..... 427/356, 358, 427/440, 441; 118/50, 125, 123, 126

[56] References Cited

U.S. PATENT DOCUMENTS

| | | | |
|---|---|---|---|
| 3,084,662 | 4/1963 | Badger | 118/50 |
| 3,511,691 | 5/1970 | Johnson et al. | 427/440 |
| 3,964,863 | 6/1976 | Carr | 427/440 |
| 4,031,276 | 6/1977 | Nakamura et al. | 427/369 |
| 4,305,976 | 12/1981 | Zubiate et al. | 427/180 |
| 4,677,002 | 6/1987 | Poterala | 427/356 |
| 4,875,434 | 10/1989 | Maejima et al. | 118/52 |
| 4,971,844 | 11/1990 | Schoustra et al. | 428/34.1 |
| 5,072,692 | 12/1991 | Ikeda | 118/713 |
| 5,112,653 | 5/1992 | Damrau et al. | 427/356 |
| 5,234,747 | 8/1993 | Walser et al. | 428/215 |
| 5,298,072 | 3/1994 | Schiele et al. | 118/681 |

*Primary Examiner*—Katherine A. Bareford
*Attorney, Agent, or Firm*—Schnader Harrison Segal and Lewis LLP

[57] ABSTRACT

Smoothing surfaces of a substrate having a profile and irregular surfaces. According to one embodiment, a layer of fill material is applied to at least one surface of the substrate, wherein the fill material fills irregularities in the at least one surface. The layer of fill material is scraped from the at least one surface to provide a relatively smooth at least one surface.

33 Claims, 6 Drawing Sheets

METHOD AND APPARATUS FOR SMOOTHING SUBSTRATE SURFACES

BACKGROUND OF THE INVENTION

Field of the Invention

The present invention relates to substrates having irregular surfaces and, in particular, to engineered wood products.

Description of the Related Art

It is known to use a variety of materials for building, construction, ornamentation, and other purposes. For example, 2"×4" wood boards are typically used for both interior and exteriors of various constructions, such as buildings or furniture. Such boards may also be used for paneling, surfacing, walls for drawers or cabinets, door jambs, crown molding, picture frames, sheathing, flooring, beam webs, ornamental purposes, and the like.

It is also known to use alternatives to such wooden materials for similar purposes, such as particle-board and oriented-strand board ("OSB"). OSB technology typically uses larger bits of wood than particle-board technology. These types of materials are often referred to as "engineered wood" or compressed wood products. Engineered wood is typically manufactured from smaller bits or pieces of wood which are then formed together by various processes into the desired overall shape of the object. One advantage to using alternative materials such as engineered wood is that they are relatively inexpensive compared to materials made of or using solid wood.

Often such alternative boards contain irregular surfaces due to their construction and the way in which they are manufactured. For example, the surface may have an overall plane or contour but with irregular holes or pits therein. Such irregular surfaces may be aesthetically or otherwise undesirable. Therefore, it is often desirable to be able to smooth or cover the surface of engineered wood products to provide a more regular, smooth surface.

One method for providing a smooth surface for engineered wood involves the gluing of thin slices of laminated wood to the surface of the engineered wood. However, this method can be relatively complex and expensive, and also may not completely cover the pits and holes in the surface, as they sometimes cause visible depressions to result in the laminate.

The Gesso process has previously been used to build up surfaces of substrates, to add bulk or size thereto. In the Gesso process, a coating called the Gesso coating, similar to a plaster of paris type substance, is applied to the surface of the substrate board. This process requires a box with templates to match the cross-section or "profile" of the substrate. For example, a rectangular 2"×4" board has a 2"×4" rectangular cross-section or profile. The templates are similar in shape to the substrate's profile, but larger than the profile of the substrate, in order to allow the surface of the substrate to be built up. Also, the templates must be larger than the substrate profile because the exact dimensions of a substrate's profile can change significantly along its length, viz., as it passes through the templates.

The substrate is passed through the box in which Gesso coating is applied repeatedly until the Gesso coating builds up so that it matches the template. Further processes such as foil or compo may be added thereafter to the Gesso coating layers that have been built up on the substrate's surface.

One problem with the Gesso process is that several passes and Gesso coatings are required. Also, Gesso coatings are relatively inflexible and are prone to cracking because of the large amount of build-up on the surface of the substrate. The Gesso process also requires changes to the templates to match different substrates with different profiles.

There is a need, therefore, for methods and apparatuses that coat or provide for smooth surfaces on substrates with irregular surfaces.

It is accordingly an object of this invention to overcome the disadvantages and drawbacks of the known art and to provide a method and apparatus that provide for smooth surfaces on substrates with irregular surfaces.

Further objects and advantages of this invention will become apparent from the detailed description of a preferred embodiment which follows.

SUMMARY OF THE INVENTION

There is provided herein an apparatus and method for smoothing surfaces of a substrate having a profile and irregular surfaces. According to one embodiment of the invention, a layer of fill material is applied to at least one surface of the substrate, wherein the fill material fills irregularities in the at least one surface. The layer of fill material is scraped from the at least one surface with a scraping means to provide a relatively smooth at least one surface.

BRIEF DESCRIPTION OF THE DRAWINGS

Other objects, features, and advantages of the present invention will become more fully apparent from the following detailed description of the preferred embodiment, the appended claims, and the accompanying drawings in which:

DESCRIPTION OF THE PREFERRED EMBODIMENT(S)

The present invention is directed to a method and apparatus for forming smooth surfaces on substrates with irregular surfaces. In the present invention, a substrate, such as a length of engineered wood having an irregular surface and a given profile, is fed through a pressurized chamber having templates at each end that approximately match the substrate's profile. The substrate is coated, as it passes through the pressurized chamber, with a fill material, that is forced under pressure into irregularities in the substrate's surface. As will be appreciated, "irregularities" as used herein refers to any pits, holes, cracks, or the like deviating from the average surface of a substrate. The first template that the substrate passes through while entering the pressurized chamber is referred to herein as the ingoing template, and the other template is the outgoing template. The outgoing template is sized and shaped such that it leaves a working excess of fill material on each surface of the substrate. The substrate then encounters an alternating series of blades designed to scrape off the excess fill material from the surface while leaving the irregularities filled with the fill material. These blades are controlled such that they adjust to the instantaneous surface of the substrate with which they are in contact, to account for changes or deviations in the substrate's profile along its length. The present invention is described in further detail hereinbelow.

Engineered Wood

As will be understood, a variety of types of material are used for construction, ornamental, and other purposes as described hereinabove, including engineered wood. Engineered wood comprises compressed particles or pieces of wood, and includes particle-board, OSB, medium-density fibre ("MDF") board, and the like. There is often a need to smooth over or fill in irregular surfaces of engineered wood and other materials or substrates having irregular surfaces, as described above. As will be appreciated, OSB is a wood composite composed of multiple layers of wood strands oriented for strength and adhered together by resins. In the present invention, a substrate such as OSB having an irregular surface is provided with a smooth surface by the use of a fill or coating material. This new relatively smooth surface may then be painted or refinished as necessary for commercial or other purposes, as will be understood.

Coating Machine

Figure 1:
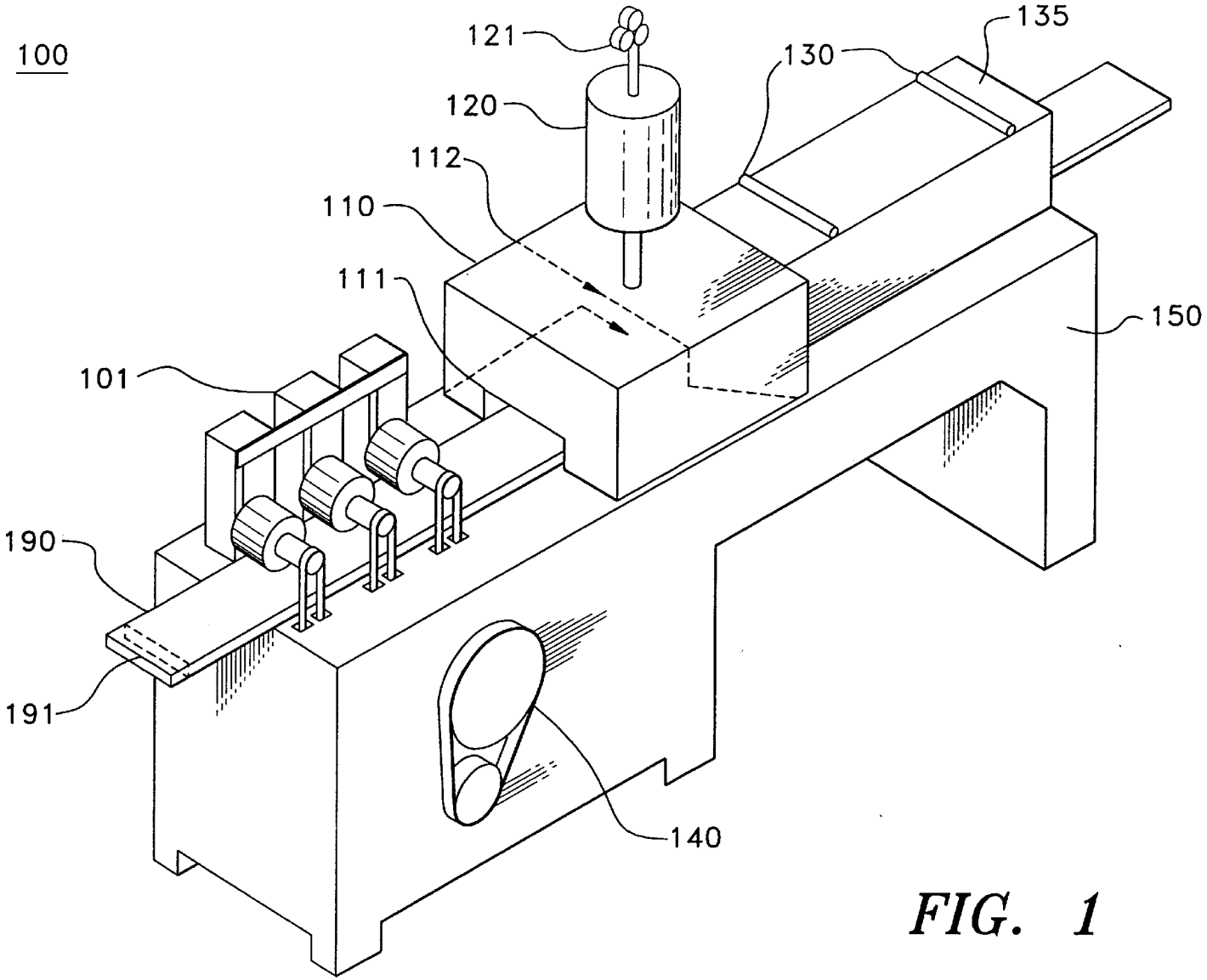
FIG. 1 shows a coating machine for coating the surface of a substrate, in accordance with a preferred embodiment of the present invention.

Referring now to FIG. 1, there is shown a coating machine 100 for coating the surface of a substrate, in accordance with a preferred embodiment of the present invention. Coating machine 100 comprises a base or table 150, chain drive 140 which turns feed wheels 101, pressurized chamber 110 having ingoing template 111 and outgoing template 112, hopper 120 with pressure gauges 121, and scraper housing 135 containing scrapers 130.

A substrate such as a length of OSB 190 having a rectangular profile 191 is fed by feed wheels 101 into pressurized chamber 110. Chain drive 140 rotates feed wheels 101, which thereby serve as a means for feeding the substrate into pressurized chamber 110. As will be understood, the speed of feed wheels 101 and chain drive 140 may be variable and controlled by a microprocessor or other regulator to optimize the coating process.

Hopper 120 contains a sufficient amount of fill material, which is delivered under pressure onto the surfaces of substrate 190 within chamber 110. In a preferred embodiment, the fill material is a waterbased extrusion filler such as product no. 604-F020-10 manufactured by Akzo Coatings, Inc., of Salem, Oreg. The fill material is preferably: a liquid, is able to air cure, and has a high solids content so that when moisture evaporates therefrom a solid is left behind adhering to the inner surfaces of the irregularities in the substrate's surface. Alternative suitable fill materials include acrylic resins comprising a sufficient mixture of microspheres and talc; the Gesso coating fill material previously described; or a 100% solid ultraviolet (UV) coating.

Figure 2A:
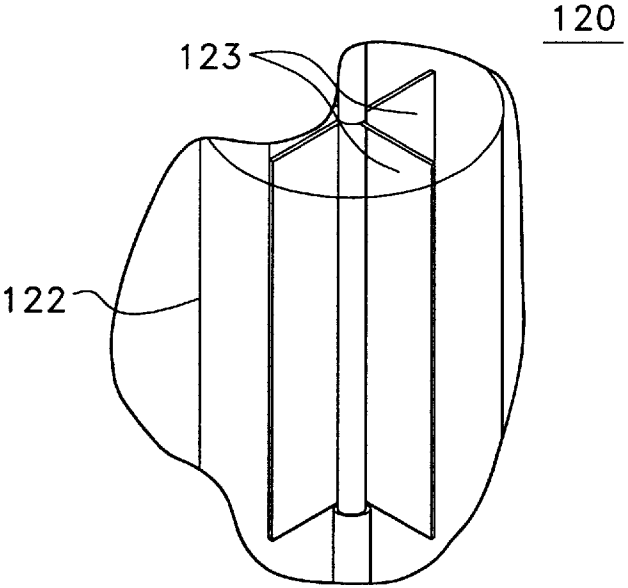
FIG. 2 illustrates the coating machine of FIG. 1 showing the hopper of the coating machine in further detail.
Figure 2:
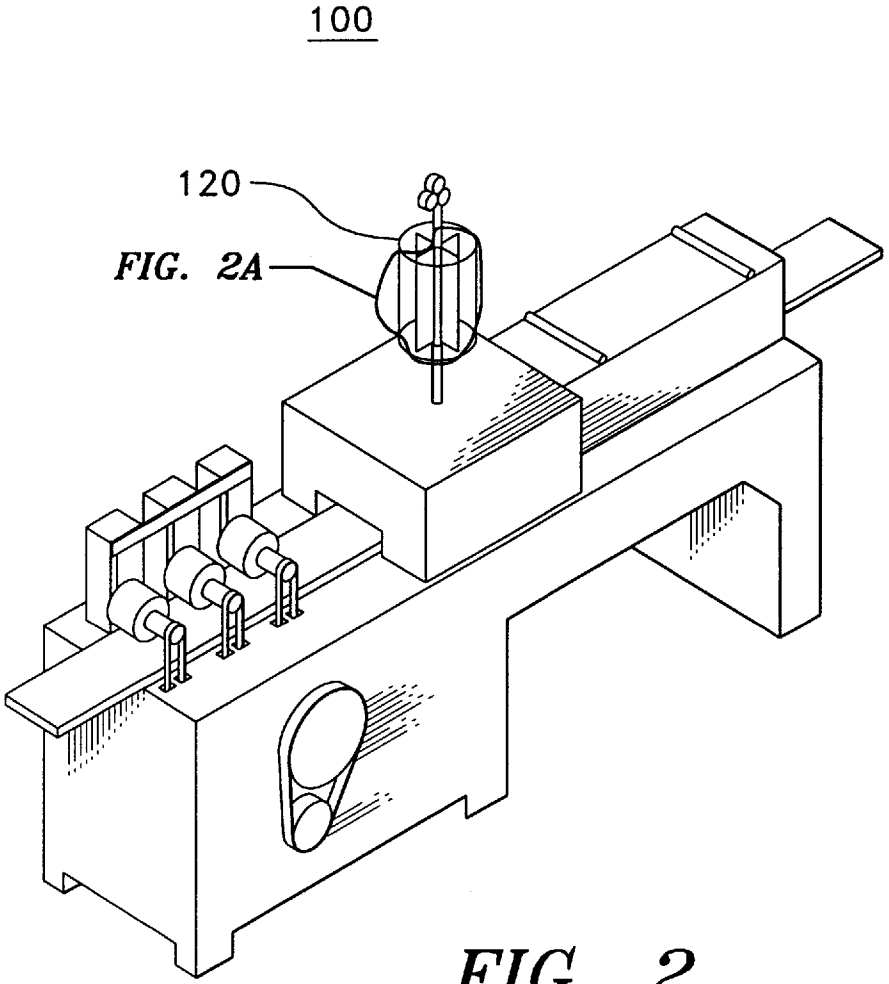

Referring now to FIG. 2, there is illustrated coating machine 100 of FIG. 1 showing the hopper of coating machine 100 in further detail. Hopper 120 preferably comprises rotating mixing paddles 123 within outer wall 122, which may be used to adjustably apply fill material to chamber 110 at a selected pressure, which may be monitored, in one embodiment, by pressure gauges 121.

As substrate 190 is fed through chamber 110, it is thereby coated with the fill material, which is forced under pressure into irregularities in the substrate's surface. Ingoing template 111 may be larger than profile 191 of substrate 190, as the ingoing motion of substrate 190 being fed into chamber 110 is in one embodiment sufficient to prevent fill material from leaking out through template 111. Outgoing template 112, illustrated in hidden view in FIG. 1, is also larger than profile 191. Because both templates 111, 112 are larger than profile 191 of substrate 190, variations in the profile size of substrate 190 along its length do not jam in either template. Outgoing template 112 scrapes off some of the fill material that has adhered to substrate 190 in chamber 110 as the substrate exits the chamber, leaving a working excess of fill material on surfaces of substrate 190 that have been coated.

As will be appreciated, chamber 110 and coating machine 100 may be designed such that only selected surfaces of substrate 190 are coated with fill material within chamber 110. For example, in one embodiment, and in FIG. 1 as illustrated, all surfaces except the bottom surface of substrate 190 are coated by fill material. As will be understood by those skilled in the art, it is often not necessary or desirable to smooth or coat all surfaces of an irregularly-surfaced substrate, for example if one plane or surface will be always invisible to users or consumer (the back side of paneling or drawer walls, for instance).

Scrapers 130 are alternating scrapers selected and configured to scrape off the excess fill material, leaving a relatively smooth surface with irregularities filled with the fill material, having a surface close to the original average surface of the substrate, i.e. without significant build-up. Scrapers 130 preferably float to match the changing profile 191 of substrate 190. Otherwise, relatively large profiled sections of substrate 190 could jam against scrapers 130 and relatively small profiled sections of the substrate could be left with an excess of fill material or with uneven fill material.

Figure 3A:
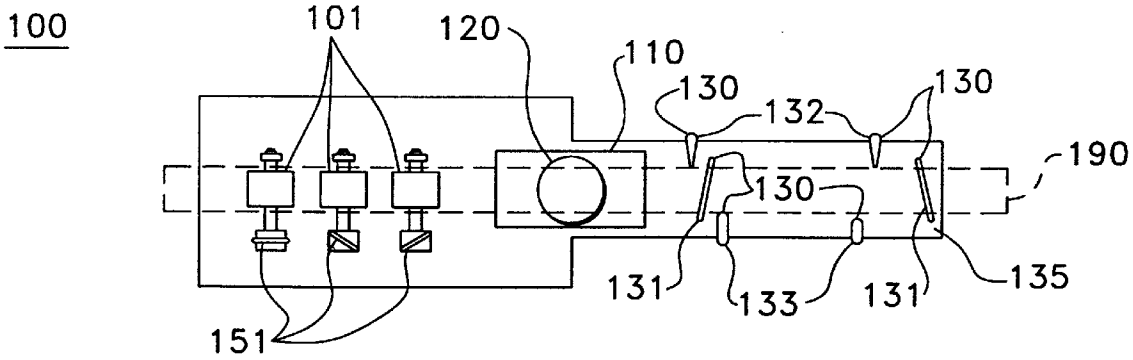
FIGS. 3A, 3B, and 3C show top, side elevation, and end views, respectively, of the coating machine of FIG. 1.
Figure 3B:
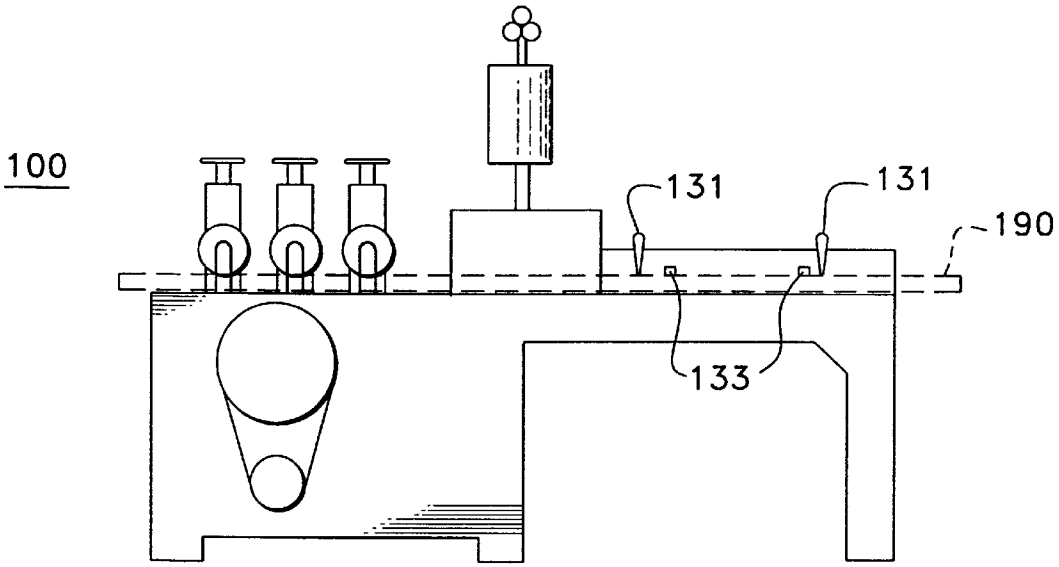
Figure 3C:
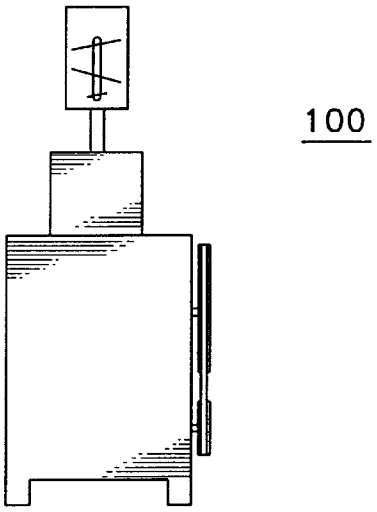

Referring now to FIGS. 3A–C, there are shown top, side elevation, and end views, respectively, of coating machine 100 of FIG. 1. As illustrated in FIG. 3A, a plurality of scrapers 130 may be utilized, such as top scrapers 131, left side scrapers 132, and right side scrapers 133 (assuming a rectangular profile 191 wherein the bottom surface of substrate 190 is not coated with fill material in chamber 110). These scraping blades are configured such that after substrate 190 exits the end of housing 135 all surfaces having fill material applied thereto have had the fill material removed except for the irregularities which have been filled. For example, as illustrated in FIG. 3A, the first left side scraper 132 may first be encountered, followed by the first top scraper 131. This top scraper may be angled as shown to force fill material scraped off the top of substrate 190 in a leftward direction to fall over the (already scraped) left side of the substrate.

As will be understood, various series and patterns of scraping blades may be selected based on empirical experimentation depending upon the profile and size of substrate 190, the fill material used, and the degree of smoothness desired.

Figure 4:
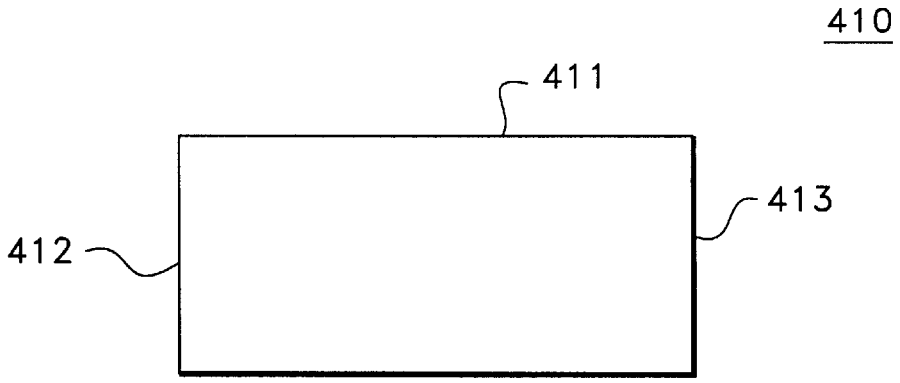
FIG. 4 shows an exemplary rectangular profile of a substrate coated by the coating machine of FIG. 1.
Figure 7:
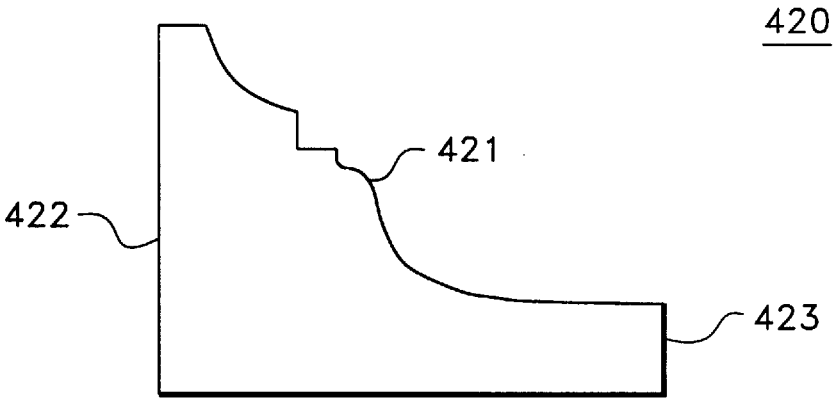
FIG. 7 shows an exemplary crown molding profile of a substrate coated by the coating machine of FIG. 1.

For example, a non-rectangular profile such as that of a length of substrate to be used for crown molding, requires a different sequence of scrapers 130, designed to scrape off each surface of substrate 190. A substrate having a rectangular profile has only four surfaces, three of which may be coated, and thereby requires three surfaces to be scraped to provide a smooth surface thereon. Other substrates such as crown molding may have dozens of surfaces, as illustrated by rectangular profile 410 and crown molding profile 420 of FIG. 4. Rectangular profile 410 may have three surfaces (left side 412, top side 411, and right side 413) coated with fill material that require scraping. By contrast, a more complex profile such as profile 420 shown in FIG. 7 has a complex top side 421, which may require several scraping blades appropriately configured in series to ensure that all sub-surfaces of side 421 are scraped of excess fill material. As will be appreciated, blades necessary to scrape side 421 may have curved edges or a combination of curved and straight edges.

Scraping Blades

Figure 5:
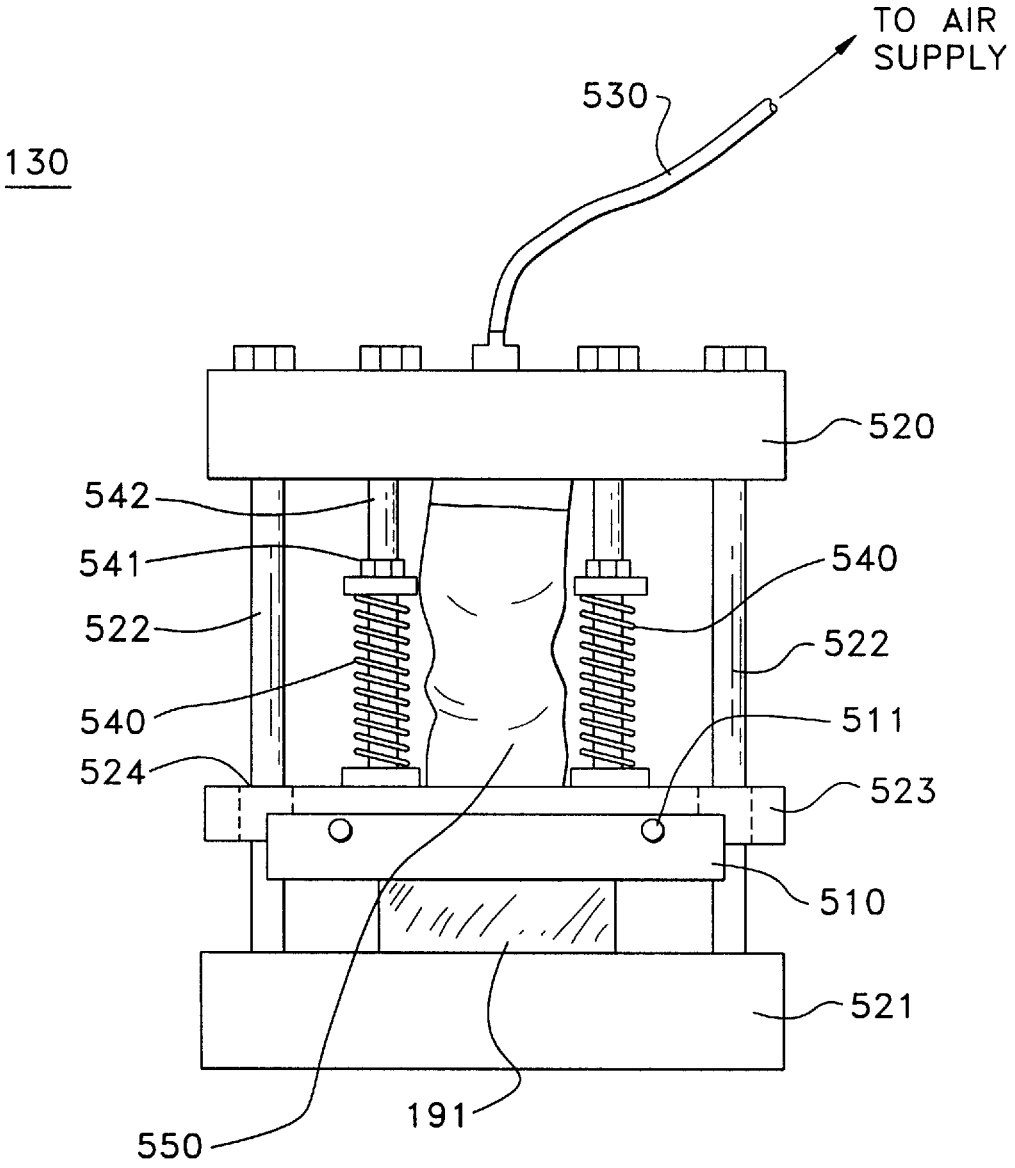
FIG. 5 is a front elevational view of a scraper of the coating machine of FIG. 1 illustrated in further detail.

As described hereinabove, scrapers 130 are preferably configured to float to follow the contours of profile 190 of substrate 191. In a preferred embodiment scrapers 130 are pneumatically-controlled blades using inflated air bags and/or cylinders, which are forced into contact with the surface of substrate 190. The contact force of the scrapers are counter-balanced with adjustable springs, as will be appreciated. Referring now to FIG. 5, there is shown in further detail a front elevational view of a scraper 130 of coating machine 100 of FIG. 1. Scraper 130 comprises an upper housing 520, affixed to a lower housing 521 by rails 522. A blade 510 for scraping the top surface of a substrate having profile 191 shown in cross-sectional view, is affixed by bolts 511 to a central housing 524. Central housing 523 contains holes 524 through which rails 522 pass, so that blade 510 is able to slide up and down on the rails between the upper and lower housings 520, 521.

Inflatable air bag 550 is secured between upper housing 520 and central housing 523, and exerts a downward force upon the central housing and blade 510, as will be appreciated, in accordance with the air pressure of air supplied via an air supply (not show) via air hose 530. Adjustable springs 540 are also mounted between upper housing 520 and central housing 523, and are configured to exert an upward force on the central housing to counter the downward force exerted by air bag 550. Adjustable springs 540 are mounted on a threaded post 542 and may be adjusted by adjusting bolt 541. Thus, blade 510 exerts a downward pressure on substrate 190, caused by both gravity and the pressure of air bag 550, which is countered by the upward force of springs 540. Thus, blade 510 "floats" upward and downward with the average surface of the profile 191 of substrate 190, while maintaining a downward force sufficient to scrape excess fill material off of substrate 190 yet leaving irregularities filled. As will be understood, air pressure delivered to or stored within air bag 150 and the tension of springs 540 may be adjusted to apply a desired amount of force to substrate 190 by blade 510.

The combination of contact force due to air pressure and the balancing force of spring resistance allows a controllable scraping force on the substrate, withing a predetermined range. For example, such scrapers 130 may be applied to scrape the surface of substrate 190 within a range of 0 to 100 psi. Scrapers 130 are also preferably adjustable away from a "zero-point" contact or default position to a designated distance away from the default surface level, for example up to four inches away. This allows scrapers 130 to be adjusted to scrape the surfaces of substrates with different profile sizes.

As will be appreciated, in an alternative embodiment a computer processor (not shown) may be programmed or designed to control the air pressure delivered to air bag 550, and/or the tension of springs 540, as well as the speed of feed wheels 101 of FIG. 1. Also, as will be understood, air cylinders or other devices having controllable downward force may be used instead of air bags in alternative preferred embodiments.

As will further be appreciated, in alternative preferred embodiments other suitable mechanisms may also be employed to provide for such floating blade action wherein the pressure exerted by the scraping blades is adjustable. For example, in one alternative preferred embodiment of the present invention, a sensor may be mounted at or near feed wheels 101 which is able to determine the instantaneous profile size of substrate 190. This information may be supplied to the processor, which is thus able to determine, given the speed of feeding substrate 190 through chamber 110, what the profile size is of the substrate as it passes under various scrapers 130. This information may be used by the computer to actuate scrapers 130 to take into account this information about the instantaneous size of the profile of substrate 190, for example to adjust the air pressure delivered to air bag 550, or, in alternative preferred embodiments, to adjust the position of the blades of various scrapers by other techniques, such as by controlling a solenoid (not shown) that controls the position of the blades.

In alternative preferred embodiments, blade 510 may be mounted to central housing by a pivot point (not shown) to allow the blade to adjust to slight variations in the angle of the surface of substrate 190 which a given blade is designed to scrape.

Coating Process

Figure 6:
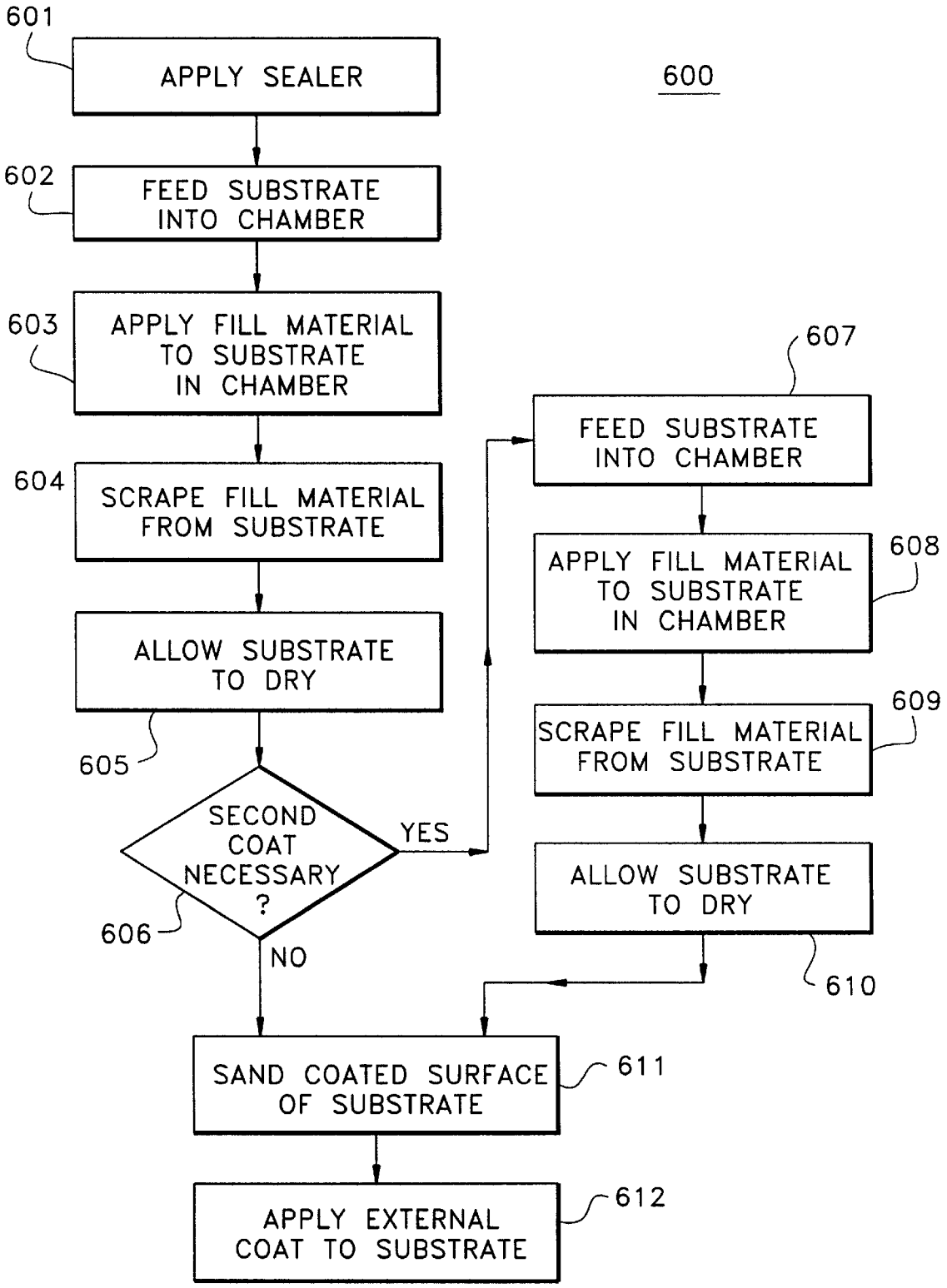
FIG. 6 illustrates a method for coating a substrate using the coating machine of FIG. 1, in accordance with a preferred embodiment of the present invention.

Referring now to FIG. 6, there is illustrated a method 600 for coating a substrate using coating machine 100 of FIG. 1 in accordance with a preferred embodiment of the present invention.

In a preferred embodiment, the following steps are performed in order to coat or provide a smooth finish to a substrate such as OSB. First, a solvent-based sealer is applied to the surfaces of substrate 190 which are to be coated (step 601 of FIG. 6). For example, every surface of a substrate other than the bottom thereof may have such sealer applied thereto. The sealer may be applied with any conventional spray or vacuum coater equipment, and is designed to stabilize the substrate at its current moisture content (assuming the current moisture content is acceptable). The sealer also allows the fill material, which is applied subsequently, to cure without hydraulic action on its water content, i.e. without the substrate leaching moisture out of the fill material. The sealer thus helps to prevent excessive shrinking, cracking, and brittleness of the fill material. Any suitable aromatic compound type sealer, such as a lacquer, may be utilized for this purposes. One preferred sealer compound is the burnishing sealer, product no. 422-F020-88, manufactured by Akzo Coatings, Inc., of Salem, Oreg.

Next, the substrate is fed into ingoing template 111 of pressurized chamber 110 of coating machine 100 of FIG. 1 by feed wheels 101 (step 602). The speed may be adjusted as desired and in accordance with the fill material used, substrate size, and the like, and may be, for example, in the range of 125 feet per second or even higher. As will be appreciated, before feeding the substrate into coating machine 101, scrapers 130 are selected and adjusted to appropriately scrape the profile of the substrate, including adjusting the default position and air bag pressure and spring tension of individual scrapers, in accordance with the size and shape of the substrate. Hopper 120 heats the fill material and injects it under pressure into chamber 110, which thereby applies the heated fill material with pressure to selected surfaces of substrate 190 (step 603). Fill material at this stage preferably contains about 80% solids. As will be appreciated, the fill material may be applied without heat, but it has been found that application and drying times are accelerated if the fill material is heated and agitated to approximately 90° to 100° F.

Thereafter, as substrate 190 continues to be fed through coating machine 100, portions having been coated in chamber 110 by the fill material are then scraped by scrapers 130 in housing 135 (step 604). As will be understood, scrapers 130 thereby scrape the surfaces of substrate 190 to remove excess fill material, leaving a relatively smooth surface. Excess fill material scraped off substrate 190 may be collected in a recovery tray and re-used. After the substrate is coated and scraped in this manner, it is allowed to dry for a sufficient time, with heat, approximately five minutes at 90° in one embodiment (step 605).

If necessary, the coated substrate may be passed through coating machine 100 a second time for a second coating (steps 606–608). If such a second coating is administered, the fill material preferably contains about 50% solids, rather than about 80% as in the first pass. A reduced solids percentage is used in the second pass to allow the filling of any remaining irregularities at higher production speeds, as will be appreciated by those skilled in the art. The substrate is then scraped and allowed to dry as before (steps 609, 610).

After substrate 190 has dried, the coated surfaces may be sanded with suitable equipment such as wide belt or multiple head profile sanders (not shown) (step 611). An external coating may then be applied, if desired, to the smoothed surface of substrate 190 (step 612), to protect the filled surface and to provide an appearance more acceptable in the market.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A method for smoothing surfaces of a substrate having a profile and irregular surfaces, the method comprising:

(a) applying fill material to at least one surface of the substrate, wherein the fill material fills irregularities in the at least one surface, wherein the substrate is composed of engineered wood;

(b) removing some of the fill material from the at least one surface to leave a working excess layer of fill material on the at least one surface; and (c) scraping the working excess layer of fill material from the at least one surface to provide a relatively smooth at least one surface.

2. The method of claim 1, wherein the substrate is composed of oriented-strand board.

3. The method of claim 1, wherein step (a) comprises the step of applying fill material under pressure to the at least one surface of the substrate with a pressurized chamber means.

4. The method of claim 3, further comprising the step of:

(d) feeding the substrate into the pressurized chamber means and through the scraping means at a selected speed.

5. The method of claim 3, wherein step (a) further comprises the step of injecting the fill material under pressure into the pressurized chamber means with a hopper means.

6. The method of claim 3, wherein the removing means is an outgoing template in the pressurized chamber means, wherein the outgoing template is sized larger than the profile of the substrate to remove all but the working excess layer of fill material.

7. The method of claim 3, wherein the pressurized chamber means further comprises means for applying fill material under heat and pressure to the at least one surface of the substrate.

8. The method of claim 1, wherein the fill material comprises a liquid water-based extrusion filler that is able to air cure and that has a solids content sufficient to cause the fill material to adhere to the surface of the substrate after moisture evaporates from the fill material remaining on the substrate after the working excess layer of fill material is scraped from the substrate.

9. The method of claim 1, wherein the scraping means comprise means for floating with changes in the profile of the substrate.

10. The method of claim 1, wherein:

the scraping means comprise a series of blade means configured to scrape the working excess layer of fill material from the at least one surface;

each blade means is for scraping one or more surfaces of the at least one surface; and each blade means comprises means for floating with changes in the one or more surfaces of the substrate.

11. The method of claim 1, wherein the means for floating of each blade means comprises a first force means pushing the blade means towards the substrate and a second force means for countering the first force means.

12. The method of claim 1, wherein the first force means comprises an adjustable air bag and the second force means comprises an adjustable spring means.

13. The method of claim 1, further comprising the steps of:

(d) applying a solvent-based sealer to the at least one surface of the substrate; and (e) feeding the substrate into the pressurized chamber means and through the scraping means at a selected speed after step (d).

14. The method of claim 1, further comprising the step of:

(d) allowing the substrate to dry after the scraping of step (c).

15. The method of claim 14, further comprising the step of:

(e) repeating steps (a)–(d) with a second fill material having a lower percentage of solids than the fill material.

16. The method of claim 14, further comprising the steps of:

(e) sanding the at least one surface of the substrate after the drying of step (d); and (f) applying an external coating to the at least one surface of the substrate after the sanding of step (e).

17. An apparatus for smoothing surfaces of a substrate having a profile and irregular surfaces, the apparatus comprising:

(a) means for applying fill material to at least one surface of the substrate, wherein the fill material fills irregularities in the at least one surface, wherein the substrate is composed of engineered wood;

(b) means for removing some of the fill material from the at least one surface to leave a working excess layer of fill material on the at least one surface; and (c) scraping means for scraping the working excess layer of fill material from the at least one surface to provide a relatively smooth at least one surface.

18. The apparatus of claim 17, wherein the substrate is composed of oriented-strand board.

19. The apparatus of claim 17, wherein means (a) comprises a pressurized chamber means for applying fill material under pressure to the at least one surface of the substrate.

20. The apparatus of claim 19, further comprising:

(d) means for feeding the substrate into the pressurized chamber means and through the scraping means at a selected speed.

21. The apparatus of claim 19, wherein means (a) further comprises a hopper means for injecting the fill material under pressure into the pressurized chamber means.

22. The apparatus of claim 19, wherein the removing means is an outgoing template in the pressurized chamber means, wherein the outgoing template is sized larger than the profile of the substrate to remove all but the working excess layer of fill material.

23. The apparatus of claim 19, wherein the pressurized chamber means further comprises means for applying fill material under heat and pressure to the at least one surface of the substrate.

24. The apparatus of claim 17, wherein the fill material comprises a liquid water-based extrusion filler that is able to air cure and that has a solids percentage high enough to cause the fill material to adhere to the surface of the substrate after moisture evaporates from the fill material remaining on the substrate after the working excess layer of fill material is scraped from the substrate.

25. The apparatus of claim 17, wherein the scraping means comprise means for floating with changes in the profile of the substrate.

26. The apparatus of claim 17, wherein:

the scraping means comprise a series of blade means configured to scrape the working excess layer of fill material from the at least one surface;

each blade means is for scraping one or more surfaces of the at least one surface; and each blade means comprises means for floating with changes in the one or more surfaces of the substrate.

27. The apparatus of claim 26, wherein the means for floating of each blade means comprises a first force means pushing the blade means towards the substrate and a second force means for countering the first force means.

28. The apparatus of claim 27, wherein the first force means comprises an adjustable air bag and the second force means comprises an adjustable spring means.

29. An apparatus for smoothing surfaces of a substrate having a profile and irregular surfaces, the apparatus comprising:

(a) means for applying fill material to at least one surface of the substrate, wherein the fill material fills irregularities in the at least one surface; wherein means (a) comprises a pressurized chamber means for applying fill material under pressure to the at least one surface of the substrate and a hopper means for injecting the fill material under pressure into the pressurized chamber means;

(b) means for removing some of the fill material from the at least one surface to leave a working excess layer of fill material on the at least one surface; and (c) scraping means for scraping the working excess layer of fill material from the at least one surface to provide a relatively smooth at least one surface.

30. An apparatus for smoothing surfaces of a substrate having a profile and irregular surfaces, the apparatus comprising:

(a) means for applying fill material to at least one surface of the substrate, wherein the fill material fills irregularities in the at least one surface; wherein means (a) comprises a pressurized chamber means for applying fill material under heat and pressure to the at least one surface of the substrate;

(b) means for removing some of the fill material from the at least one surface to leave a working excess layer of fill material on the at least one surface; and (c) scraping means for scraping the working excess layer of fill material from the at least one surface to provide a relatively smooth at least one surface.

31. An apparatus for smoothing surfaces of a substrate having a profile and irregular surfaces, the apparatus comprising:

(a) means for applying fill material to at least one surface of the substrate, wherein the fill material fills irregularities in the at least one surface;

(b) means for removing some of the fill material from the at least one surface to leave a working excess layer of fill material on the at least one surface; and (c) scraping means for scraping the working excess layer of fill material from the at least one surface to provide a relatively smooth at least one surface, wherein the fill material comprises a liquid water-based extrusion filler that is able to air cure and that has a solids percentage high enough to cause the fill material to adhere to the surface of the substrate after moisture evaporates from the fill material remaining on the substrate after the working excess layer of fill material is scraped from the substrate.

32. An apparatus for smoothing surfaces of a substrate having a profile and irregular surfaces, the apparatus comprising:

(a) means for applying fill material to at least one surface of the substrate, wherein the fill material fills irregularities in the at least one surface;

(b) means for removing some of the fill material from the at least one surface to leave a working excess layer of fill material on the at least one surface; and (c) scraping means for scraping the working excess layer of fill material from the at least one surface to provide a relatively smooth at least one surface, wherein the scraping means comprise means for floating with changes in the profile of the substrate.

33. An apparatus for smoothing surfaces of a substrate having a profile and irregular surfaces, the apparatus comprising:

(a) means for applying fill material to at least one surface of the substrate, wherein the fill material fills irregularities in the at least one surface;

(b) means for removing some of the fill material from the at least one surface to leave a working excess layer of fill material on the at least one surface; and (c) scraping means for scraping the working excess layer of fill material from the at least one surface to provide a relatively smooth at least one surface;

wherein:

the scraping means comprise a series of blade means configured to scrape the working excess layer of fill material from the at least one surface;

each blade means is for scraping one or more surfaces of the at least one surface; and each blade means comprises means for floating with changes in the one or more surfaces of the substrate.

* * * * *